US006478241B1

(12) United States Patent
Guo

(10) Patent No.: US 6,478,241 B1
(45) Date of Patent: Nov. 12, 2002

(54) SPRINKLER HAVING INDIVIDUALLY OPERATED OUTLET OPENINGS

(76) Inventor: Wen Li Guo, No. 10, Fang Dong Road, Wen Gin Tsuen, Fang Yuan Hsiang, Chang Hua Hsien (TW)

( * ) Notice: Subject to any disclaimer, the term of this patent is extended or adjusted under 35 U.S.C. 154(b) by 42 days.

(21) Appl. No.: 09/678,239

(22) Filed: Oct. 4, 2000

(51) Int. Cl.[7] ..... A62C 37/20
(52) U.S. Cl. ..... 239/562; 239/242
(58) Field of Search ..... 239/242, 240, 239/562, 551

(56) References Cited

U.S. PATENT DOCUMENTS 3,423,024 A * 1/1969 Morawetz ..... 239/242
4,452,397 A * 6/1984 Barton ..... 239/562
5,340,030 A * 8/1994 Siegrist, Jr. ..... 239/562
5,511,727 A * 4/1996 Herren et al. ..... 239/242
5,562,247 A 10/1996 Roman ..... 239/240
5,628,458 A * 5/1997 Kuo ..... 239/242
5,645,218 A * 7/1997 Heren et al. ..... 239/242
5,657,928 A * 8/1997 Jian ..... 239/242
5,845,850 A 12/1998 Guo ..... 239/242
6,062,490 A * 5/2000 Katzer et al. ..... 239/562

* cited by examiner

*Primary Examiner*—Lesley D. Morris
(74) *Attorney, Agent, or Firm*—Charles E. Baxley

(57) ABSTRACT

A sprinkler includes a pipe having a number of outlet openings for outward flow of the water, and a number of rings rotatably engaged on the pipe and each having an orifice for selectively aligning with the outlet opening of the pipe and for selectively blocking the outlet opening, such that the outlet openings of the pipe may be selectively opened or blocked by the rings. A housing is engaged on the pipe and has a number of apertures for slidably receiving the actuating ears of the rings to limit the movement of the ring relative to the pipe.

3 Claims, 4 Drawing Sheets

SPRINKLER HAVING INDIVIDUALLY OPERATED OUTLET OPENINGS

BACKGROUND OF THE INVENTION

1. Field of the Invention

The present invention relates to a sprinkler, and more particularly to a sprinkler having one or more individually operatable outlet openings.

2. Description of the Prior Art

U.S. Pat. No. 5,562,247 to Roman, and U.S. Pat. No. 5,845,850 to Guo disclose two typical sprinklers having a number of openings or outlets formed in or along a tube for outward flowing of the water. The outlets of the tube may not be opened or blocked or operated individually.

The present invention has arisen to mitigate and/or obviate the afore-described disadvantages of the conventional sprinklers.

SUMMARY OF THE INVENTION

The primary objective of the present invention is to provide a sprinkler including one or more individually operatable outlet openings that may be selectively opened or blocked to control the outward flow of the water and to control the spraying area required.

In accordance with one aspect of the invention, there is provided a sprinkler comprising a pipe including at least one outlet opening formed therein, and at least one ring rotatably engaged on the pipe and aligned with the outlet opening of the pipe, the ring including an orifice formed therein for selectively aligning with the outlet opening of the pipe and for selectively blocking the outlet opening of the pipe.

The ring includes an actuating ear extended therefrom for rotating the ring relative to the pipe. A sealing ring is further provided and engaged between the pipe and the ring. The pipe includes a circular groove formed around the outlet opening of the pipe for receiving the sealing ring.

A limiting device is further provided for limiting a movement of the ring relative to the pipe and includes a housing engaged on the pipe, the housing includes at least one aperture formed therein, the limiting device further includes an actuating ear extended from the ring and slidably received in the aperture of the housing.

The housing includes two casings secured together, the casings each includes the aperture formed therein for slidably receiving the actuating ear of the ring.

Further objectives and advantages of the present invention will become apparent from a careful reading of a detailed description provided herinbelow, with appropriate reference to accompanying drawings.

DETAILED DESCRIPTION OF THE PREFERRED EMBODIMENT

Figure 1:
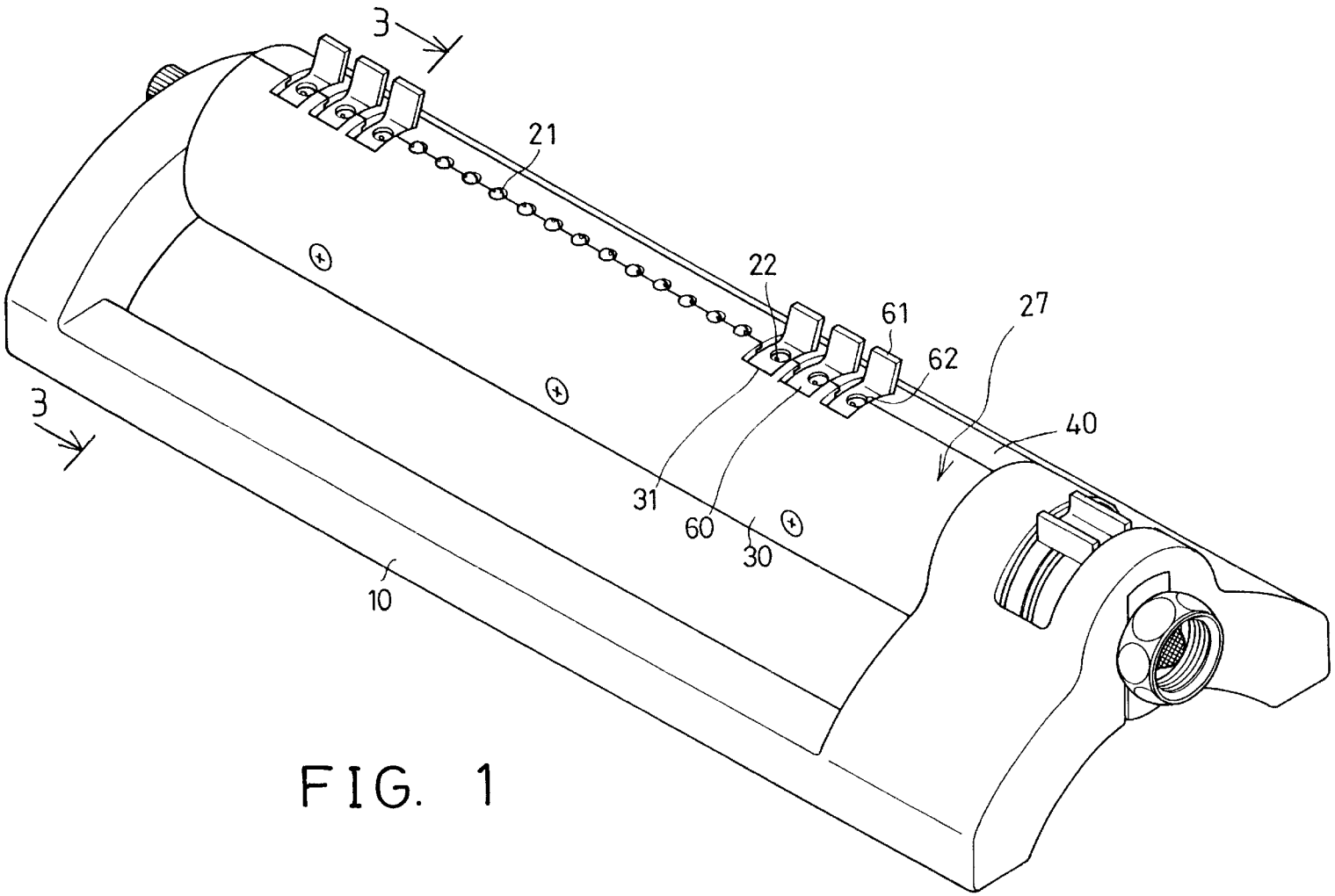
FIG. 1 is a perspective view of a sprinkler in accordance with the present invention.
Figure 2:
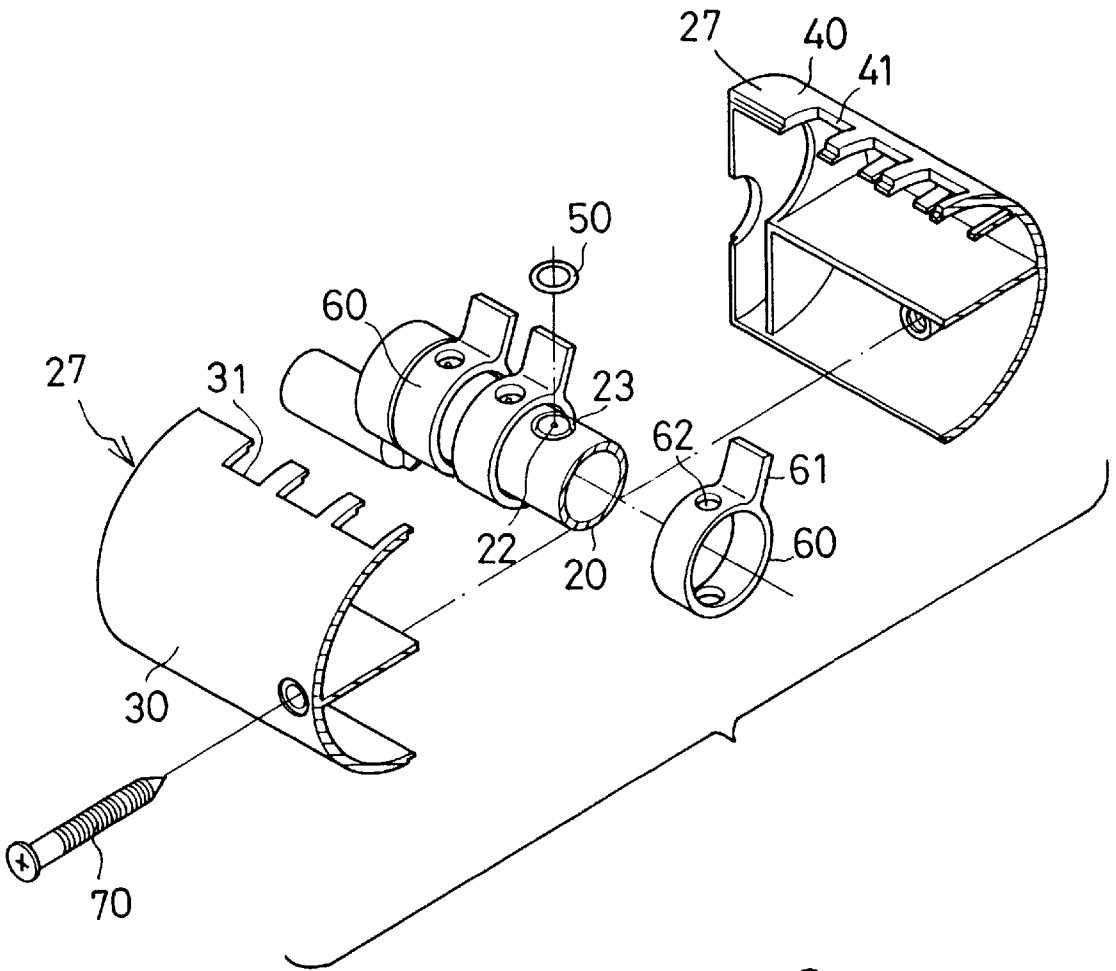
FIG. 2 is a partial exploded view of the sprinkler.
Figure 3:
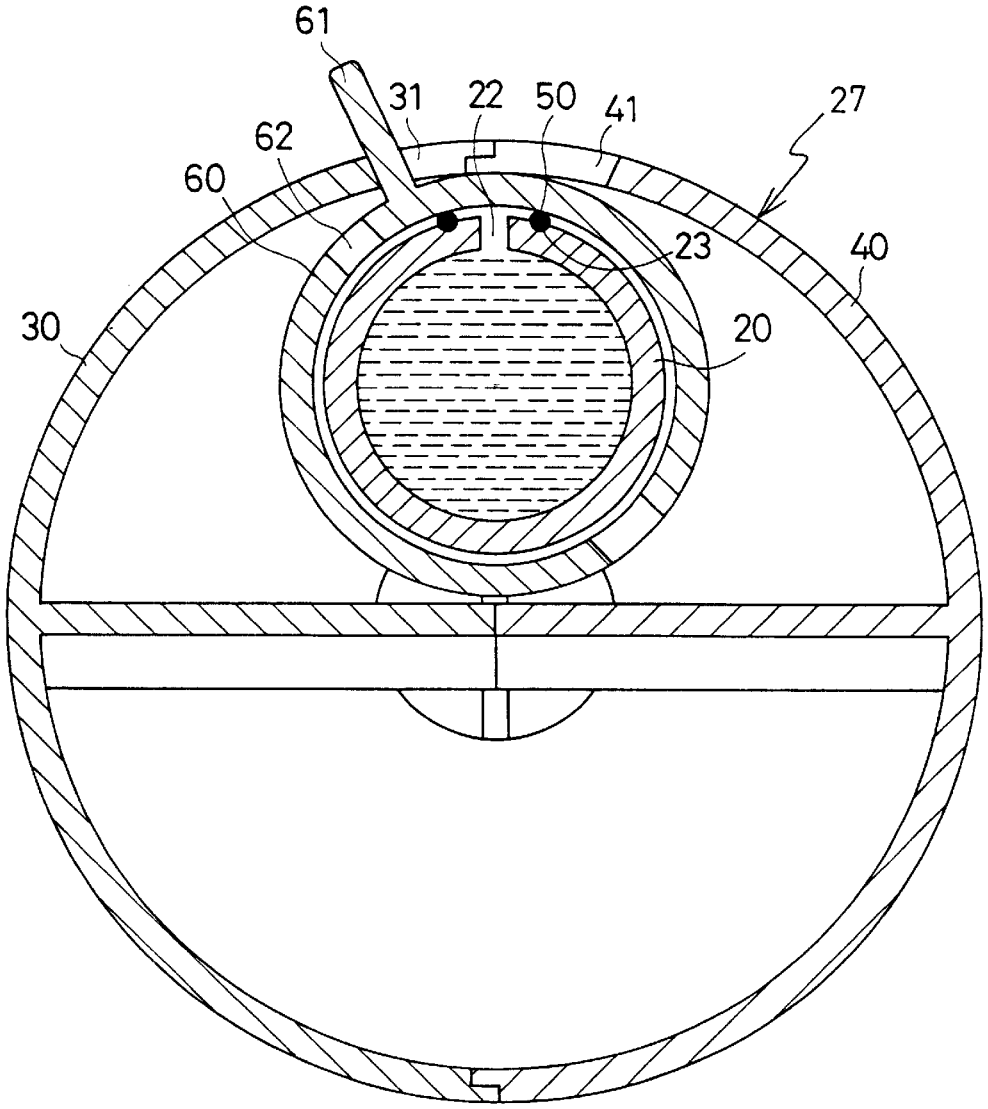
FIG. 3 is a partial cross sectional view taken along lines 3—3 of FIG. 1.

Referring to the drawings, and initially to FIGS. 1–3, a sprinkler in accordance with the present invention comprises a water pipe 20 secured in a support 10 and including an inlet for receiving the water and, selectively, an exit for discharging the water. The pipe 20 includes one or more outlet openings 21, 22 formed therein and aligned in a straight line or in a helical line or the like. The pipe 20 includes one or more circular grooves 23 formed around the outlet openings 22 respectively for receiving sealing rings 50 respectively. One or more rings 60 are rotatably engaged on the pipe 20 and each includes an orifice 62 formed therein for aligning with the openings 22 of the pipe 20 respectively (FIGS. 2, 4), and each includes an actuating ear 61 extended radially outward therefrom for rotating the rings 60 relative to the pipe 20. The sealing rings 50 are engaged between the pipe 20 and the rings 60 for making a water tight seal between the pipe 20 and the rings 60.

A housing 27 is secured on the support 10 and engaged on the pipe 20, or the pipe 20 is received in the housing 27. The housing 27 includes two casings 30, 40 secured together by fasteners 70 and includes one or more apertures 31, 41 formed therein, such as formed in the casings 30, 40 respectively for slidably receiving the actuating ears 61 of the rings 60. As best shown in FIGS. 1 and 2, the apertures 31, 41 of the housing 27 includes a width equal to that of the actuating ears 61 such that the actuating ears 61 of the rings 60 may be guided and limited to slide along the respective apertures 31, 41 of the housing 27 and such that the rings 60 may be prevented from moving laterally relative to the pipe 20, and such that the rings 60 may be prevented from being disengaged from the outlet openings 22 of the pipe 20.

Figure 4:
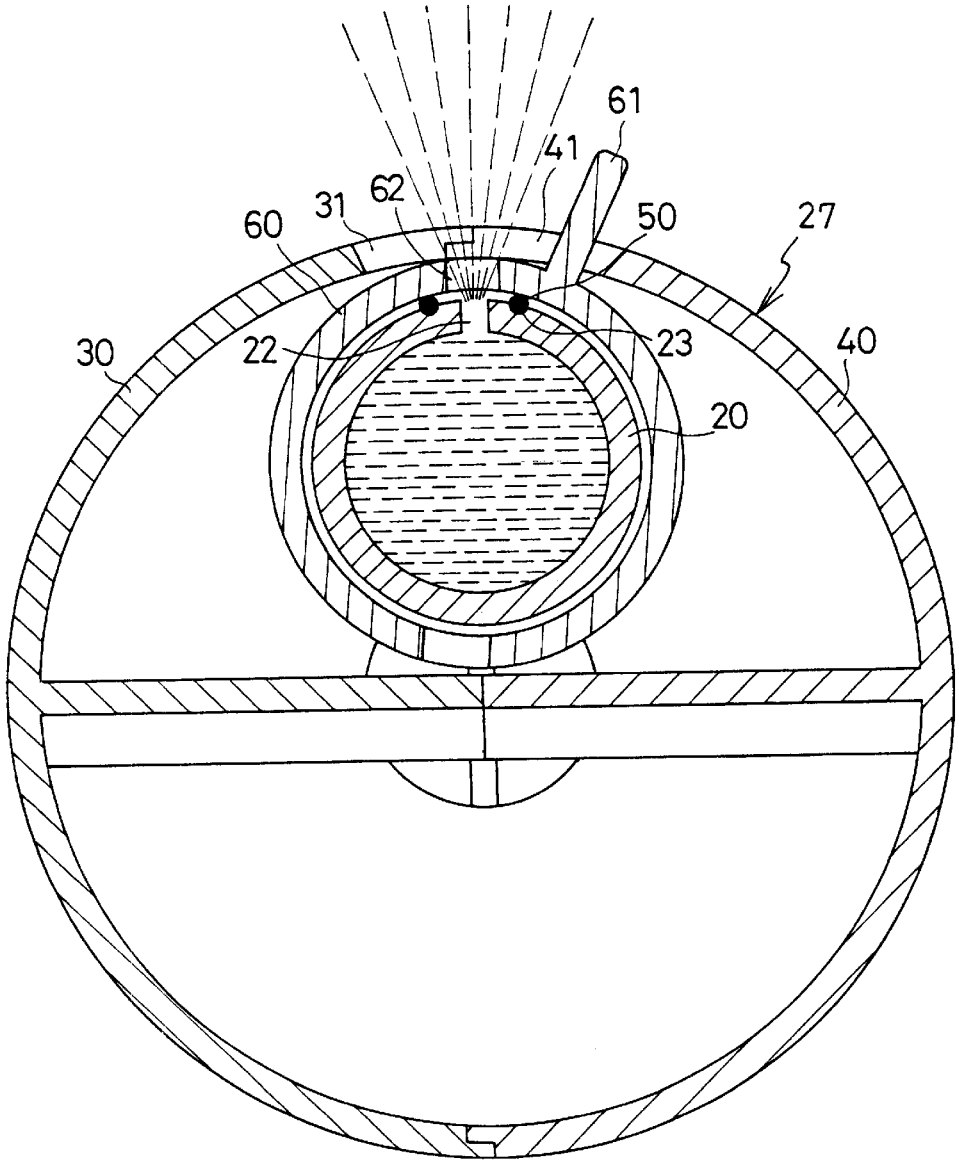
FIG. 4 is a partial cross sectional view similar to FIG. 3, illustrating the operation of the sprinkler.

In operation, as shown in FIG. 3, when the orifice 62 of the ring 60 is disengaged from the outlet opening 22 of the pipe 20 by rotating the ring 60 with the actuating ear 61 thereof, the outlet opening 22 of the pipe 20 may be blocked and the water may not flow out through the outlet opening 22 of the pipe 20 at this moment. As shown in FIG. 4, when the ring 60 is rotated relative to the pipe 20 by the actuating ear 61 to align the orifice 62 of the ring 60 with the outlet opening 22 of the pipe 20, the outlet opening 22 of the pipe 20 is not blocked and is opened such that the water may flow out through the outlet opening 22 of the pipe 20 at this moment. The outlet openings 22 of the pipe 20 may thus be individually opened or blocked with the rings 60 respectively. The openings 21 of the pipe 20 that are not required to be blocked have no control rings 60 engaged thereon. The opening and the blocking of the outlet openings 22 of the pipe 20 may control the outward flow of the water and may control the outwardly spraying area of the water.

Accordingly, the sprinkler in accordance with the present invention includes one or more individually operatable outlet openings that may be selectively opened or blocked to control the outward flow of the water and to control the spraying area required.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprinkler comprising:

a pipe including at least one outlet opening formed therein, at least one ring rotatably engaged on said pipe and aligned with said at least one outlet opening of said pipe, said at least one ring including an orifice formed therein for selectively aligning with said at least one outlet opening of said pipe and for selectively blocking said at least one outlet opening of said pipe, and a housing engaged on said pipe, said housing including two casings secured together and each having at least one aperture formed therein, and said at least one ring including an actuating ear extended therefrom and slidably received in said at least one apertures of said casings of said housing, for limiting a movement of said at least one ring relative to said pipe.

2. The sprinkler according to claim 1 further comprising a sealing ring engaged between said pipe and said at least one ring.

3. The sprinkler according to claim 2, wherein said pipe includes a circular groove formed around said at least one outlet opening of said pipe for receiving said sealing ring.

* * * * *